US011085731B2

(12) United States Patent
Freitas

(10) Patent No.: US 11,085,731 B2
(45) Date of Patent: Aug. 10, 2021

(54) RIFLE SLING

(71) Applicant: William Freitas, Millis, MA (US)

(72) Inventor: William Freitas, Millis, MA (US)

( * ) Notice: Subject to any disclaimer, the term of this patent is extended or adjusted under 35 U.S.C. 154(b) by 0 days.

(21) Appl. No.: 16/907,692

(22) Filed: Jun. 22, 2020

(65) Prior Publication Data

US 2020/0400402 A1 Dec. 24, 2020

Related U.S. Application Data

(60) Provisional application No. 62/865,739, filed on Jun. 24, 2019.

(51) Int. Cl.
*F41C 23/02* (2006.01)
*F41C 33/00* (2006.01)

(52) U.S. Cl.
CPC ..... *F41C 23/02* (2013.01); *F41C 33/002* (2013.01)

(58) Field of Classification Search
CPC ..... F41C 33/002; F41C 33/001; F41C 23/02; Y10S 224/913
USPC ..... 224/258, 257, 150
See application file for complete search history.

(56) References Cited

U.S. PATENT DOCUMENTS

| | | | | |
|---|---|---|---|---|
| 4,817,835 A * | 4/1989 | Tarr, Jr. | F41C 33/002 224/150 |
| D370,751 S * | 6/1996 | Hodgson | D30/153 |
| 8,210,405 B1 * | 7/2012 | Pritchard | F41C 33/002 224/150 |
| 2003/0041498 A1 * | 3/2003 | Mazzagetti | F41C 33/002 42/85 |
| 2004/0245297 A1 * | 12/2004 | Sinclair | F41C 33/002 224/150 |

* cited by examiner

*Primary Examiner* — Corey N Skurdal
(74) *Attorney, Agent, or Firm* — Steven N. Fox, Esq.

(57) ABSTRACT

The present invention is a rifle sling for use with a rifle having butt and barrel portions. The rifle sling comprises a one-piece leather strap comprising a central longitudinal axis, a fixed end portion, and a sliding end portion. The sliding end portion comprises a slit that is parallel to the central longitudinal axis of the strap. The sliding end portion being folded to form first and twisted second loops with the first loop passing thru the second loop to form a sliding knot. The fixed end portion comprises first and second slits parallel to the central longitudinal axis and aligned with each other. The fixed end portion being folded to form a loop that is passed thru the first and second slits to form a fixed knot. Unlike conventional rifle slings, the rifle sling of the present invention does not employ any hardware.

14 Claims, 9 Drawing Sheets

RIFLE SLING

CROSS-REFERENCE TO RELATED APPLICATIONS

This application claims priority to and the benefit of U.S. Provisional Application Ser. No. 62/865,739 filed on Jun. 24, 2019, which is hereby incorporated by reference in its entirety.

BACKGROUND OF THE INVENTION

Rifle slings have existed for many years as a means to carry and position a rifle. Conventional rifle slings are cumbersome by requiring the use of buckles, hooks, hardware and gadgets needed to accomplish the task of length adjustment and securing the sling after making adjustments. Further, lengthening and shortening of conventional rifle slings, especially under duress, typically requires both hands to be used for making adjustments. Further, conventional rifle slings also do not allow for enough length adjustment to allow different aiming, carry and shooting positions. Still further, conventional slings require too much time to make adjustments. Further, conventional slings using too much hardware can easily confuse the user and require too much time and thought to make adjustments. The additional hardware can be time consuming and cumbersome to use as well as adding unneeded weight and discomfort.

SUMMARY OF THE INVENTION

The present invention is a rifle sling for use with a rifle having butt and barrel portions. In one embodiment, the rifle sling comprises a one-piece leather strap comprising a central longitudinal axis, a fixed end portion, and a sliding end portion. The sliding end portion comprises a first slit that is parallel to the central longitudinal axis of the strap. The sliding end portion being folded to form first and second loops. Each of the first and second loops are twisted. The first loop passing thru the second loop to form a sliding knot. The fixed end portion passing thru the first and second loops. The fixed end portion comprises first and second slits parallel to said central longitudinal axis. The first slit of the fixed end portion is aligned with the second slit of the fixed end portion. The fixed end portion being folded to form a loop. The loop of the fixed end portion passing thru the first and second slits of the fixed end portion to form a fixed knot. Unlike conventional rifle slings, the strap of the rifle sling of the present invention does not employ any hardware.

BRIEF DESCRIPTION OF THE DRAWINGS

The following description of the invention will be more fully understood with reference to the accompanying drawings, in which.

DESCRIPTION OF THE INVENTION

Figure 1:
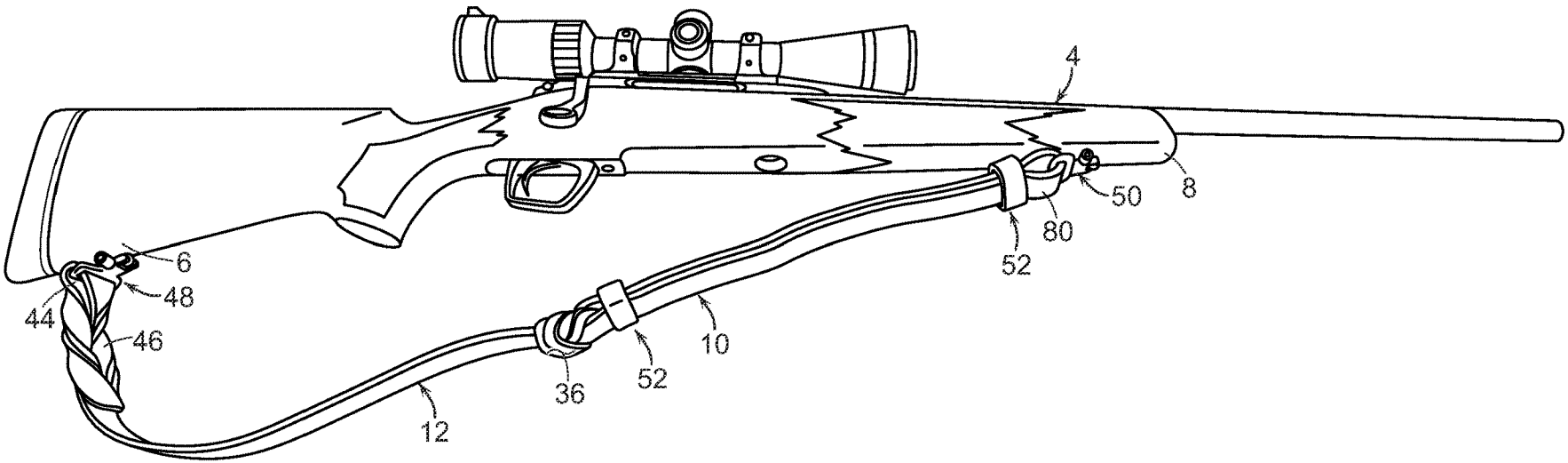
FIG. 1 is a perspective view of a rifle sling according to the present invention attached to a rifle.
Figure 2:
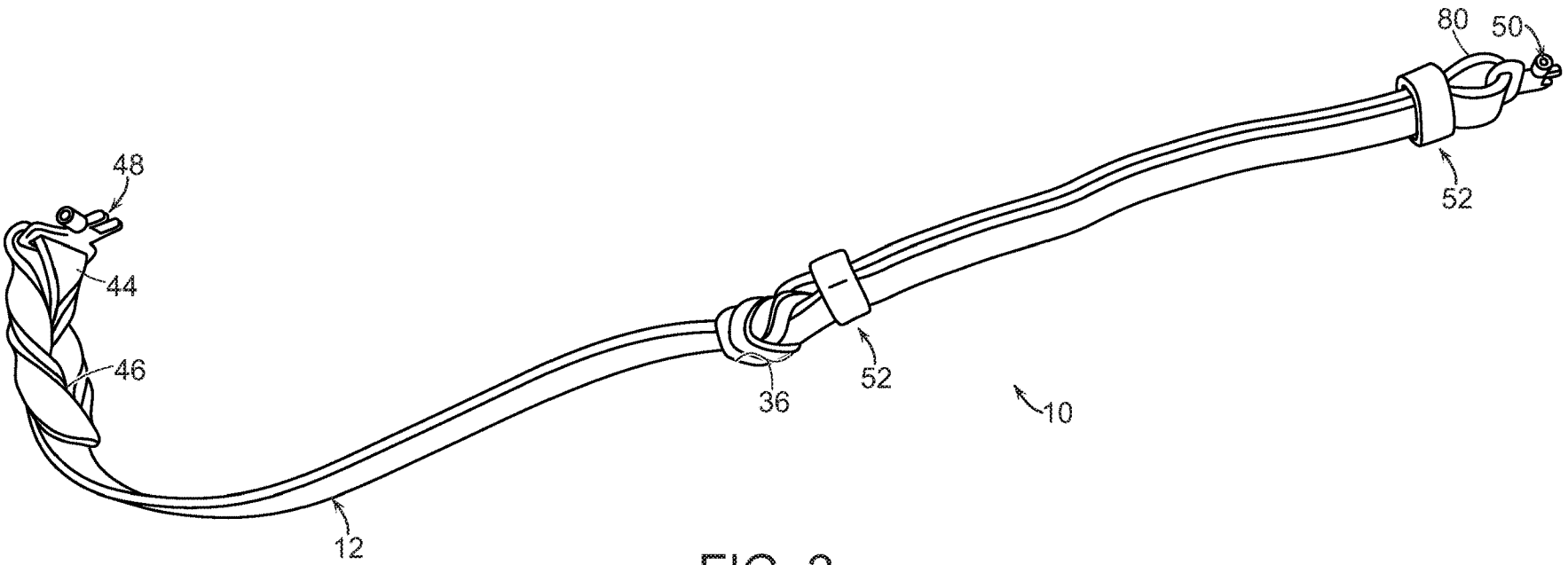
FIG. 2 is a perspective view of the rifle sling.

Referring to FIGS. 1 and 2, the present invention is a rifle sling 10 for use with a conventional rifle 4 that provides multiple options for carry and shooting positions. Rifle 4 generally comprises a butt portion 6 and a barrel portion 8, and may be any type of conventional or futurely developed rifle. As will be described herein, rifle sling 10 comprises a single piece of strap 12 that is formed without any added specialized hardware such as hooks or buckles. Conventional and widely available swivel clips 48 and 50 are engaged with a free portion 80 and a loop 44 (to be described) of strap 12 that engage with butt portion 6 and barrel portion 8, respectively, of rifle 4. Loop 44 is secured by a fixed knot 46 (to be described) that is formed without any hardware. The length of strap 12 is adjusted by a sliding knot 36 (to be described) that is formed without any hardware. Although not necessary, a keeper 52 may be secured about strap 12 at one or more places to maintain overlapping portions of strap 12 in an engaged position near, for example near sliding knot 36 and free portion 80.

Figure 3:
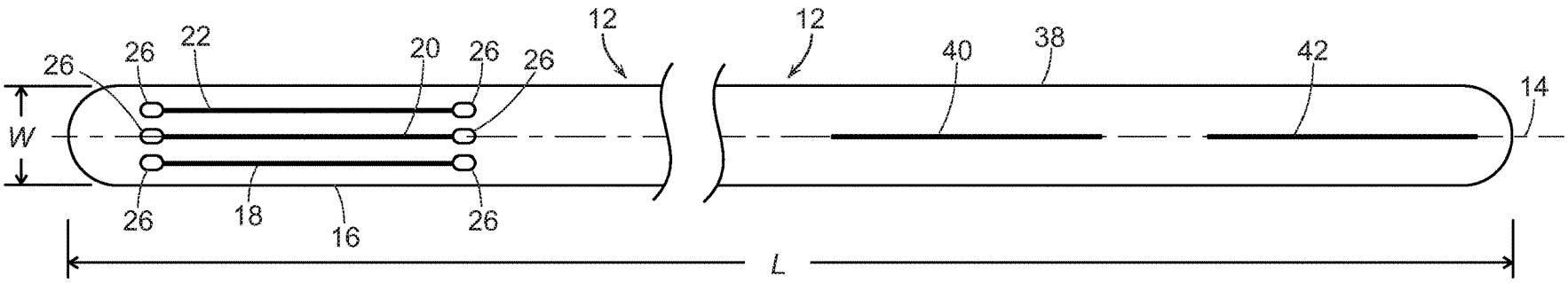
FIG. 3 is a top view of the strap with a sliding end portion having three (3) slits parallel to a central longitudinal axis of the strap and a fixed end portion having two (2) slits aligned with and parallel to the central longitudinal axis.

Referring to FIG. 3, strap 12 generally comprises a central longitudinal axis 14, a sliding end portion 16, and a fixed end portion 38. Strap 12 is preferably flat and made of leather. Strap 12 is formed by conventional cutting operations and is widely available as larger pieces or rolls of leather. Strap 12 has an overall length L of about fifty-five (55) to sixty-five (65) inches. Strap 12 has an overall width W of about one and a quarter (1.25) inches. Strap 12 has a thickness of about 0.19 inches. Strap 12 may be made from other soft, flexible and substantially flat materials or fabrics such as a cloth or nylon. Sliding end portion 16 of strap 12 comprises a first slit 18, a second slit 20, and a third slit 22. Sliding end portion 16 further comprises an opening 26 at both ends of first slit 18, second slit 20, and third slit 22. Fixed end portion 38 of strap 12 comprises a first slit 40 and a second slit 42. First slit 40 and second slit 42 are each parallel to central longitudinal axis 14. First slit 40 is aligned with second slit 42.

Figure 4:
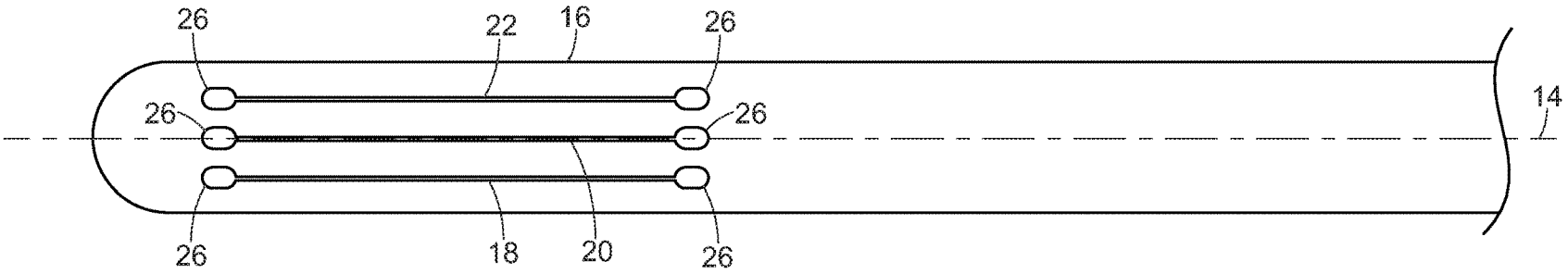
FIG. 4 is an enlarged top view of the sliding end portion of the strap having three (3) slits parallel to the central longitudinal axis of the strap.

Referring to FIG. 4, first slit 18, second slit 20, and third slit 22 of sliding portion 16 of strap 12 are each disposed parallel to central longitudinal axis 14 of strap 12. In the embodiment shown, first slit 18, second slit 20, and third slit 22 are equally spaced from each other. First slit 18, second slit 20, and third slit 22 may be formed by a convention die cutting operation with a single die block.

Figure 6:
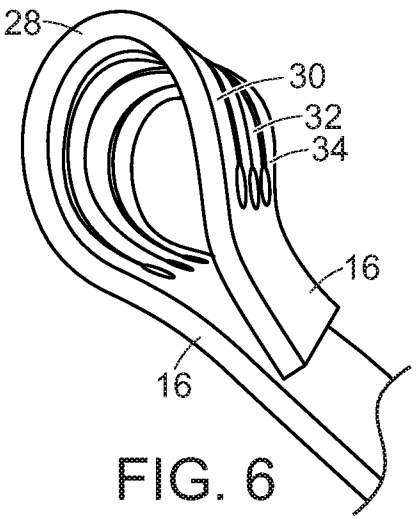
FIG. 6 is a close up side perspective view of the sliding end portion folded to form four (4) loops.
Figure 5:
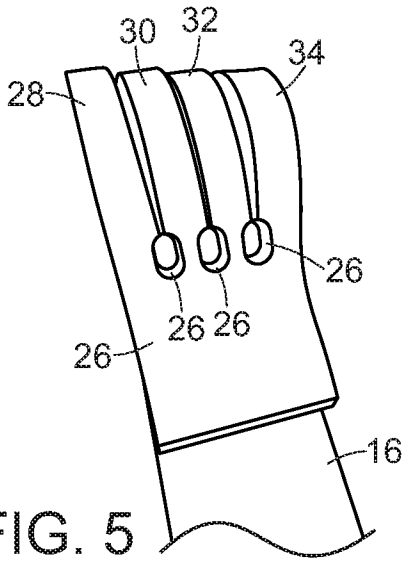
FIG. 5 is a close up bottom perspective view of the sliding end portion folded to form four (4) loops.

Referring to FIG. 5-6, sliding end portion 16 of rifle sling 10 is folded to form a first loop 28, a second loop 30, a third loop 32, and a fourth loop 34.

Figure 7:
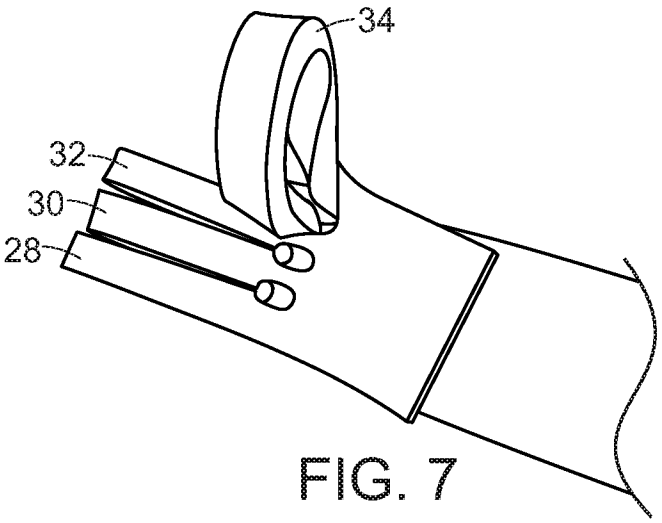
FIG. 7 is a close up bottom perspective view of the sliding end portion with one loop twisted and the three (3) other loops untwisted.

Referring to FIG. 7, fourth loop 34 of sliding end portion 16 is shown partially twisted to temporarily secure fourth loop 34 in place. About a quarter twist of fourth loop 34 is sufficient. Opening 26 helps twisting of fourth loop 34. Although not shown twisted, first loop 28, second loop 30, and third loop 32 are also twisted in the same manner as fourth loop 34 and each opening 26 helps with twisting and temporary securement.

Figure 8:
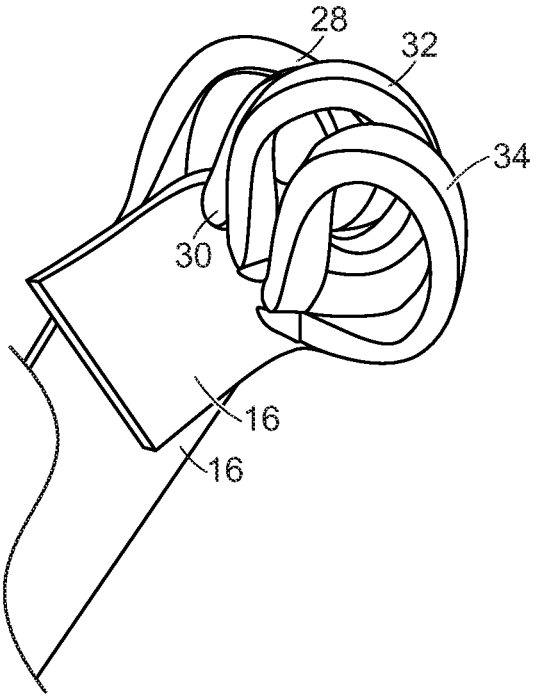
FIG. 8 is a close up bottom perspective view of the sliding end portion with all four (4) loops twisted.
Figure 9:
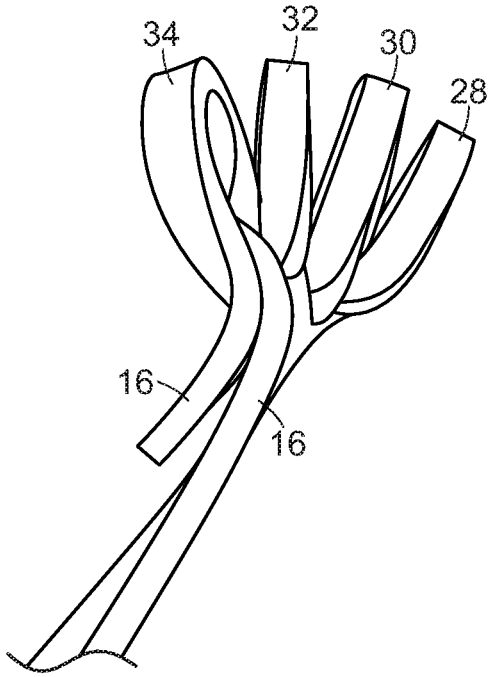
FIG. 9 is a close up side perspective view of the sliding end portion with all four (4) loops twisted.

Referring to FIGS. 8 and 9, first loop 28, second loop 30, third loop 32, and fourth loop 34 are each shown twisted.

Figure 10:
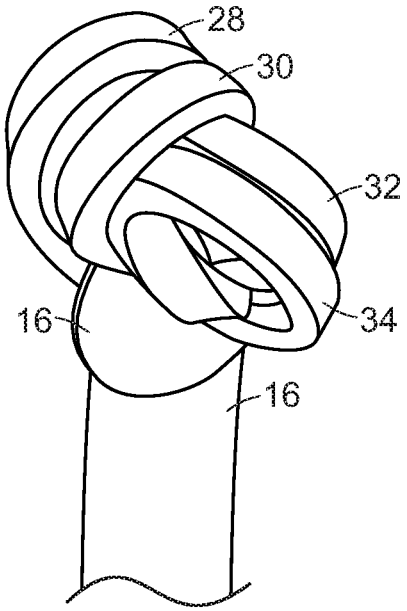
FIG. 10 is a close up side top perspective of the four (4) loops of the sliding end portion with two adjacent twisted loops partially passed thru the other two adjacent twisted loops.

Referring to FIG. 10, first loop 28, second loop 30, third loop 32, and fourth loop 34 of sliding end portion 16 are shown with two adjacent twisted loops 32 and 34 partially passed thru the twisted loops 28 and 30.

Figure 11:
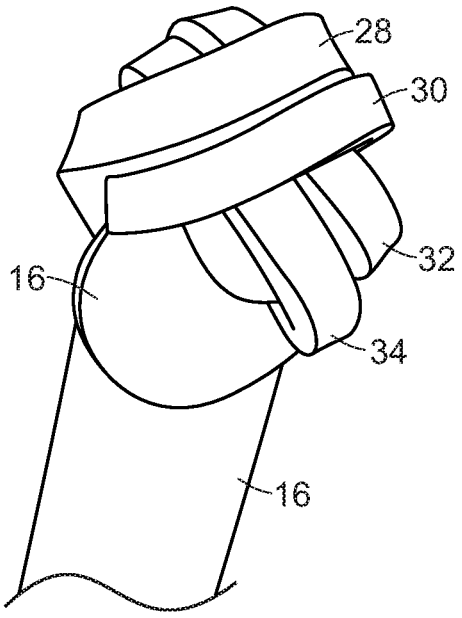
FIG. 11 is a close up top perspective view of the four (4) loops of the sliding end portion with two adjacent twisted loops passed thru the other two adjacent twisted loops.

Referring to FIG. 11, twisted loops 32 and 34 are shown fully passed thru twisted loops 28 and 30.

Figure 12:
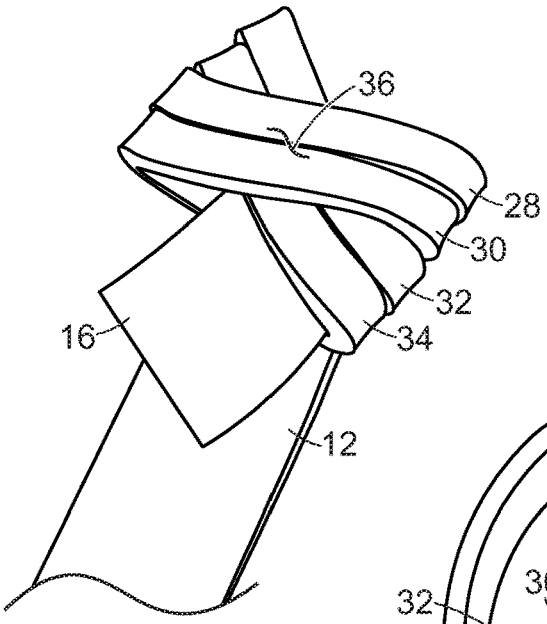
FIG. 12 is a close up top perspective view of the four (4) loops of the sliding end portion with two adjacent twisted loops fully passed thru the other two adjacent twisted loops and stretched to form a sliding knot without any hardware.

Referring to FIG. 12, twisted loops 32 and 34 are shown fully passed thru twisted loops 28 and 30 and stretched to form a sliding knot 36 without any hardware. Stretching of twisted loops 28 and 30 and twisted loops 32 and 34 may be accomplished by insertion of a conventional needle nose plier into twisted loops 28 and 30 and twisted loops 32 and 34, and then opening the pliers to stretch the twisted loops 28, 30, 32, and 34 to form sliding knot 36.

Figure 13:
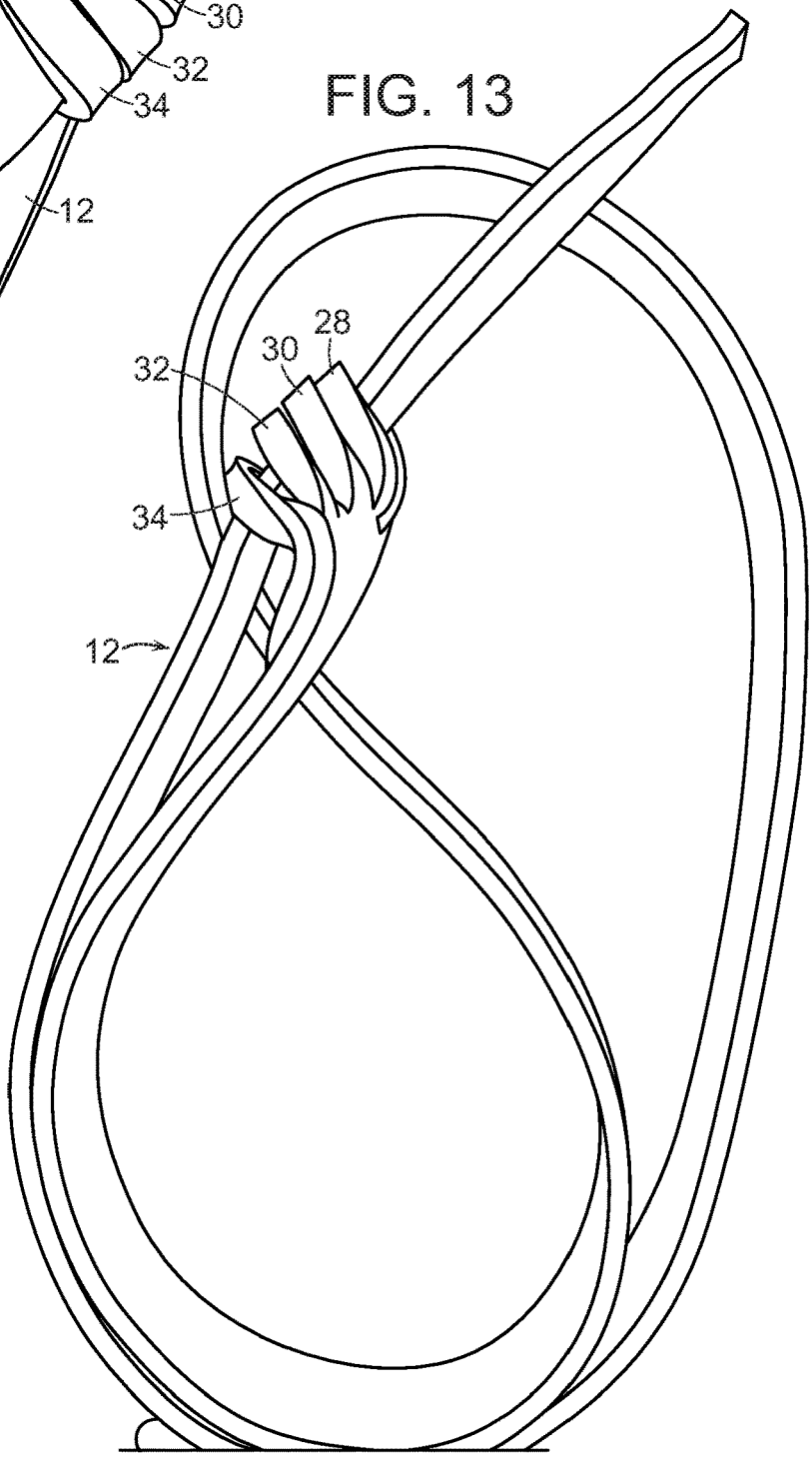
FIG. 13 is a perspective side view of the strap passing thru the four (4) loops of the sliding end portion that are secured by the sliding knot.

Referring to FIG. 13, strap 12 is shown passing thru first loop 28, second loop 30, third loop 32, and fourth loop 34. Sliding end portion 16 of strap 12 (or first loop 28, second loop 30, third loop 32, and fourth loop 34) can slide along the length of strap 12 to any desired position thereby allowing rapid adjustment.

Figure 14:
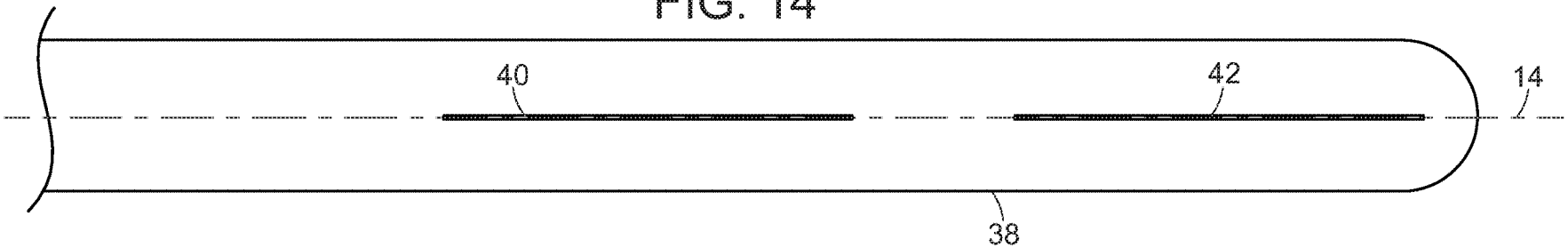
FIG. 14 is a close up view of the fixed end portion of the strap having first and second slits aligned with and parallel with the central longitudinal axis of the strap.

Referring to FIG. 14, where a close up view of fixed end portion 38 of strap 12 is shown comprising first and second slits 40 and 42 disposed parallel with central longitudinal axis 14 of strap 12. First slit 40 is aligned with second slit 42. First and second slits 40 and 42 of fixed end portion 38 may be formed by a convention die cutting operation with a single die block.

Figure 15:
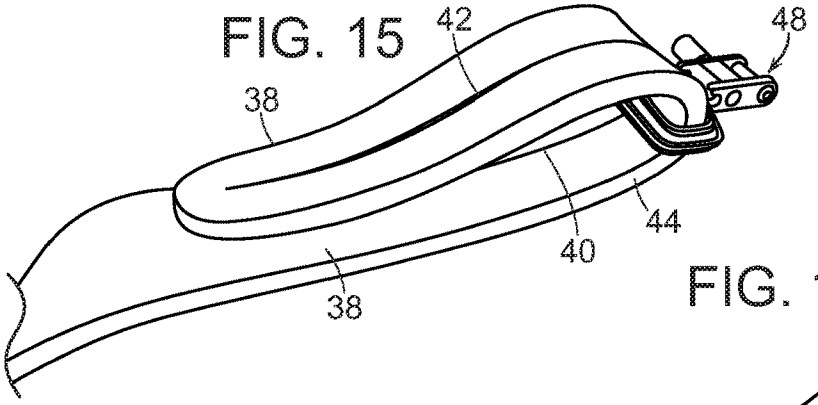
FIG. 15 is a close up bottom perspective view of the fixed end portion folded to form a single loop. A swivel clip is mounted to the fixed end portion before folding.

Referring to FIG. 15, fixed end portion 38 of strap 12 is folded to form a single loop 44. Swivel clip 48 is mounted to the fixed end portion 38 before folding.

Figure 16:
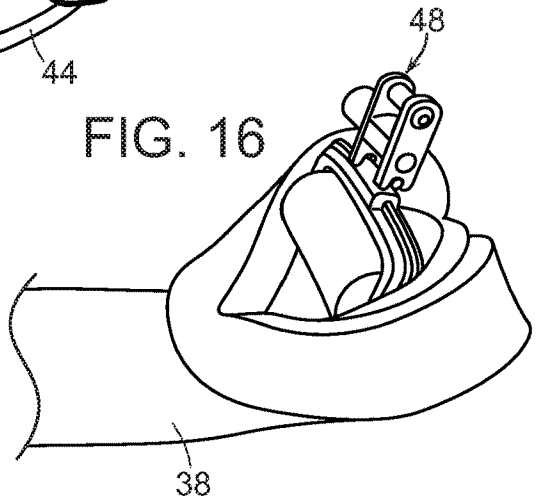
FIG. 16 is a close up bottom perspective view of the fixed end portion with the single loop partially passed thru the first and second slits.

Referring to FIG. 16, loop 44 of fixed end portion 38 (with swivel clip 48) is shown partially passed thru first and second slits 40 and 42.

Figure 17:
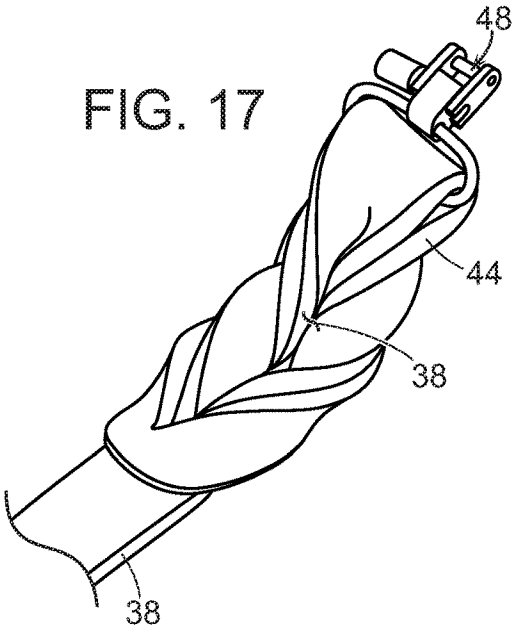
FIG. 17 is a close up perspective view of the fixed end portion with the single loop fully passed thru the first and second slits to form a fixed knot without any hardware.

Referring to FIG. 17, loop 44 of fixed end portion 38 (with swivel clip 48) is shown fully passed thru first and second slits 40 and 42 to form a fixed knot 46 to secure loop 44 without any hardware.

Figure 18:
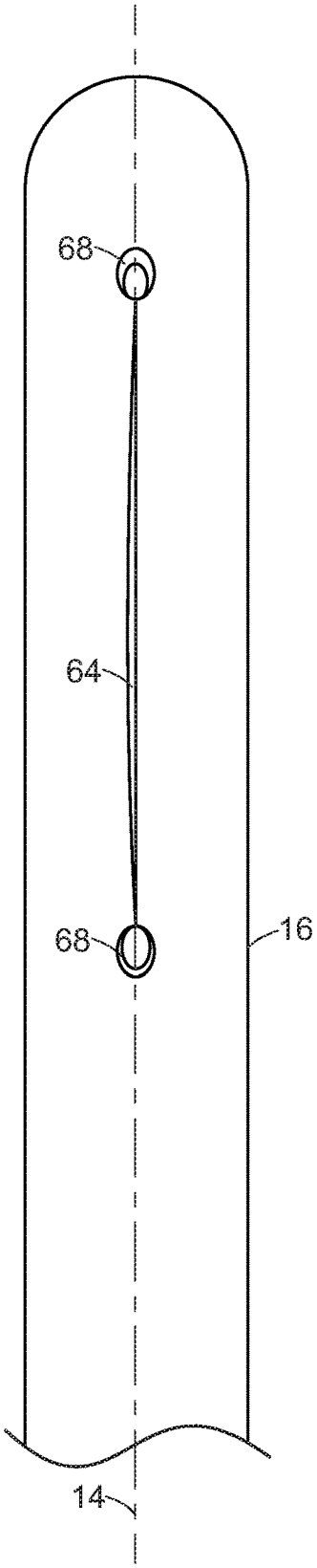
FIG. 18 is a close up view of a second embodiment of the rifle sling with the sliding end portion of the strap having a single slit parallel to the central longitudinal axis of the strap.

Referring to FIG. 18, is a close up view of a second embodiment of rifle sling 10 with sliding end portion 16 of strap 12 having a single slit 64 disposed parallel to central longitudinal axis 14 of strap 12. As in the first embodiment, an opening 68 is provided at each end of slit 64.

Figure 19:
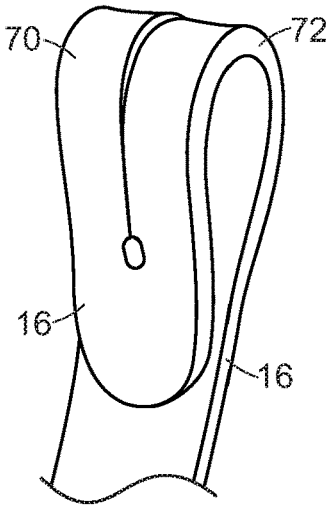
FIG. 19 is a close up view of the sliding end portion of the second embodiment folded to form two (2) loops.

Referring to FIG. 19, sliding end portion 16 is folded to form first and second loops 70 and 72.

Figure 20:
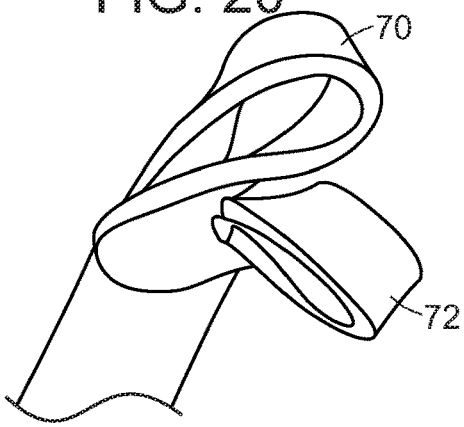
FIG. 20 is a close up bottom perspective view of the sliding end portion of the second embodiment with the two (2) loops twisted.

Referring to FIG. 20, sliding end portion 16 is shown with first and second loops 70 and 72 twisted.

Figure 21:
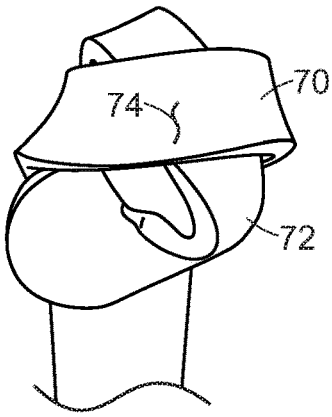
FIG. 21 is a close up bottom perspective view of the sliding end portion of the second embodiment with one twisted loop passing through the other twisted loop (and being stretched) to form a sliding knot without any hardware.

Referring to FIG. 21, sliding end portion 16 is shown with twisted loop 72 passing through twisted loop 70 to form a sliding knot 74 without any hardware.

Figure 22:
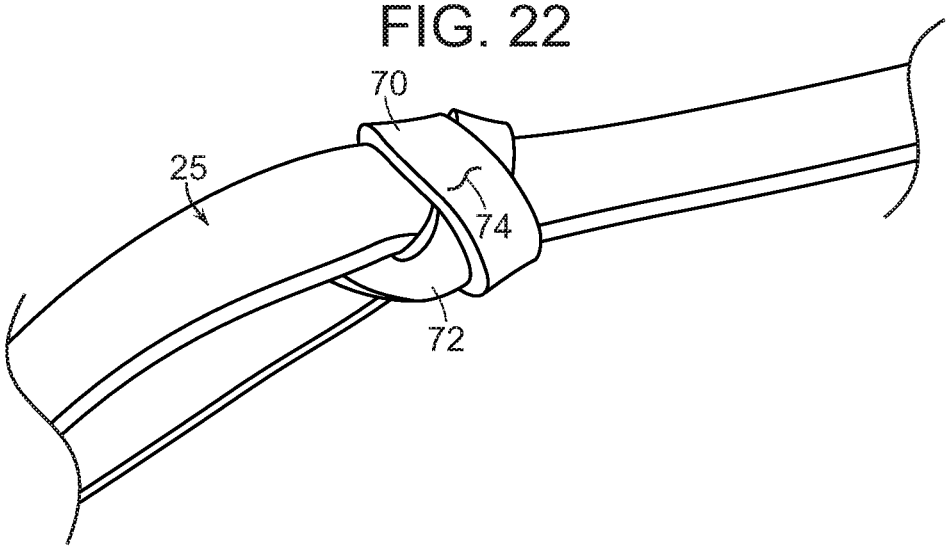
FIG. 22 is a close up perspective view showing the strap passing through the first and second loops secured by the sliding knot of the second embodiment.

Referring to FIG. 22, strap 12 is shown passing through first and second loops 70 and 72. Sliding end portion 16 of strap 12 (or first loop 70 and second loop 72) can be moved along the length of strap 12 to any desired position thereby allowing rapid adjustment.

Figure 23:
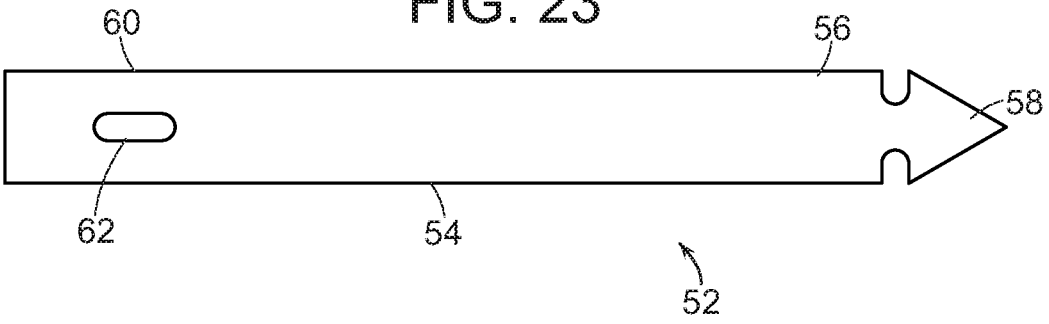
FIG. 23 is a top view of a keeper in an open position formed with a male end portion and a female end portion.

Referring to FIG. 23, a keeper 52 in the form of a short strap 54 is shown in an open position formed with a male end portion 56 and a female end portion 60. Male end portion 56 comprises a male fastener 58. In the embodiment shown, male fastener 58 is formed as an arrow head. Female end portion 60 comprises a female fastener 62 that securely engages with male fastener 50. In the embodiment shown, female fastener 62 is an opening 64 sized to removably receive and secure male fastener 58.

Figure 24:
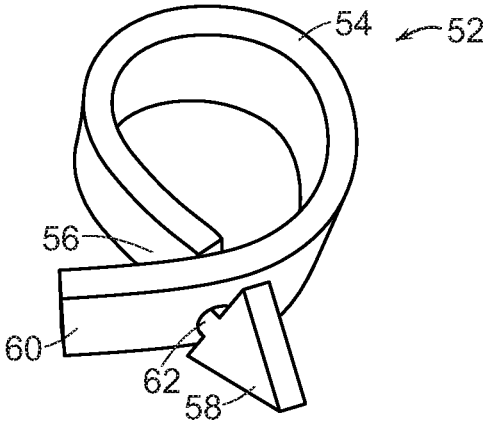
FIG. 24 is a top view of a keeper in a closed position with the male end portion inserted into the female end portion.

FIG. 24 is a top view of keeper 52 in a closed position with male fastener 58 of male end portion 58 removably inserted or engaged with female fastener 62 of female end portion 60. Thereafter, keeper 52 is the turned inside out as shown in FIGS. 1 and 2. In the embodiment shown, rifle sling 10 comprises a keeper 52 disposed near free portion 80 of strap 12 and a keeper 52 disposed near sliding knot 36 to engaged overlapping portions of strap 12.

The rifle sling 10 of present invention can also be used for other purposes such as pet leashes or leads, luggage or baggage straps, fashion accessories, boat rigging or lines.

While particular embodiments of the invention have been shown and described, it will be obvious to those skilled in the art that changes and modifications may be made without departing from the scope of the claimed invention.

What is claimed:

1. A rifle sling for use with a rifle having butt and barrel portions, the sling comprising:

a one-piece leather strap comprising a central longitudinal axis, a fixed end portion, and a sliding end portion; said sliding end portion comprise a slit that is parallel to said central longitudinal axis of said strap; said sliding end portion being folded to form first and second loops; each of said first and second loops are twisted; said first loop passing thru said second loop to form a sliding knot; and said fixed end portion passing thru said first and second loops.

2. The rifle sling of claim 1, wherein said fixed end portion comprises a first and second slits parallel to said central longitudinal axis; said first slit is aligned with said second slit; said fixed end portion being folded to form a loop; said loop of said fixed end portion passing thru said first slit and said second slit of said fixed end portion to form a fixed end knot.

3. The rifle sling of claim 2, further comprising a first fastener engaged with said loop of said fixed end portion for removable engagement with the barrel portion of the rifle.

4. The rifle sling of claim 3, further comprising a second fastener engaged with a free portion of said strap for removable engagement with the butt portion of the rifle.

5. The rifle sling of claim 4, wherein said first fastener is a swivel clip.

6. The rifle sling of claim 5, wherein said second fastener is a swivel clip.

7. The rifle sling of claim 1, where said strap is made of leather.

8. A rifle sling for use with a rifle having butt and barrel portions, the sling comprising:

a one-piece leather strap comprising a central longitudinal axis, a fixed end portion, and a sliding end portion; said sliding end portion comprises first, second, and third slits that are parallel to said central longitudinal axis of said strap; said sliding end portion being folded to form first, second, third and fourth loops; each of said first, second, third, and fourth loops are twisted; said first and second loops passing thru said third and fourth loops to form a sliding knot; and said fixed end portion passing thru said first, second, third, and fourth loops.

9. The rifle sling of claim 8, wherein said fixed end portion comprises a first slit and a second slit parallel to said central longitudinal axis; said first slit is aligned with said second slit; said fixed end portion being folded to form a loop; said loop of said fixed end portion passing thru said first slit and said second slit of said fixed end portion.

10. The rifle sling of claim 9, further comprising a first fastener engaged with said loop of said fixed end portion for removable engagement with the barrel portion of the rifle.

11. The rifle sling of claim 10, further comprising a second fastener engaged with a free portion of said strap for removable engagement with the butt portion of the rifle.

12. The rifle sling of claim 11, wherein said first fastener is a swivel clip.

13. The rifle sling of claim 12, wherein said second fastener is a swivel clip.

14. The rifle sling of claim 8, where said strap is made of leather.

* * * * *